United States Patent [19]

Kobler

[11] Patent Number: 4,605,212

[45] Date of Patent: Aug. 12, 1986

[54] DEVICE ON A FOLDING GRIPPER CYLINDER TO ACCEPT FOLDED PRODUCTS

[75] Inventor: Ingo Kobler, Anhausen, Fed. Rep. of Germany

[73] Assignee: M.A.N. Roland Druckmaschinen Aktiengesellschaft, Offenbach am Main, Fed. Rep. of Germany

[21] Appl. No.: 757,005

[22] Filed: Jul. 19, 1985

[30] Foreign Application Priority Data

Jul. 26, 1984 [DE] Fed. Rep. of Germany ..... 3427559

[51] Int. Cl.[4] ..... B65H 39/02

[52] U.S. Cl. ..... 270/54; 271/69; 198/476.1; 198/485.1; 493/442

[58] Field of Search ..... 270/54–58, 270/45; 271/69, 82, 204, 277; 198/476.1, 485.1, 486.1, 627, 644; 493/416, 424, 432, 434, 435, 442

[56] References Cited

U.S. PATENT DOCUMENTS

| | | | |
|---|---|---|---|
| 2,765,164 | 10/1956 | Hand | 493/434 |
| 3,131,801 | 5/1964 | Marchetti | 198/485.1 |
| 3,572,683 | 3/1971 | Hepp | 270/54 |
| 3,809,214 | 5/1974 | Reist | 271/204 |
| 4,336,875 | 6/1982 | Minnetti | 198/486.1 |
| 4,424,965 | 1/1984 | Faltin | 271/204 |
| 4,445,881 | 5/1984 | Bullen et al. | 493/427 |
| 4,494,949 | 1/1985 | Baley | 493/442 |

*Primary Examiner*—E. H. Eickholt

*Attorney, Agent, or Firm*—Frishauf, Holtz, Goodman & Woodward

[57] ABSTRACT

For accepting folded products (5) and transporting them further, a revolving belt or chain system (7) on which drivers (8) are provided is used following the transfer point between a folding blade cylinder (1) and a folding gripper cylinder (2). After the folded spine (6) has been grasped by the folding grippers (4) of the folding gripper cylinder (2), drivers (8) are laterally inserted into the wedge-shaped region A, after which the folding grippers open. Then the drivers (8) accept the folded products (5) from the folding gripper cylinder (2) or the folding blade cylinder (1) and guide them further, preferably in a suspended condition, for further handling.

15 Claims, 12 Drawing Figures

Fig. 12
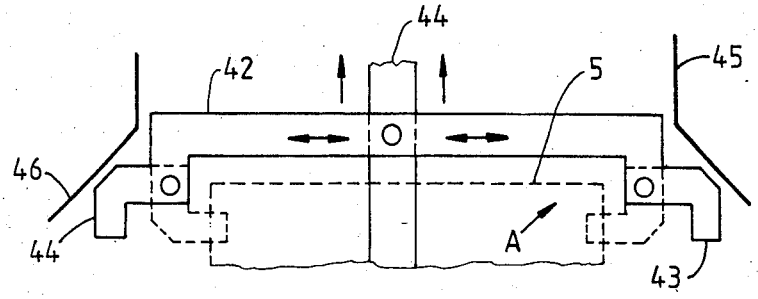
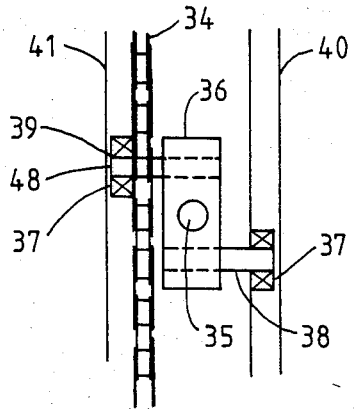
Fig. 11
Fig. 10
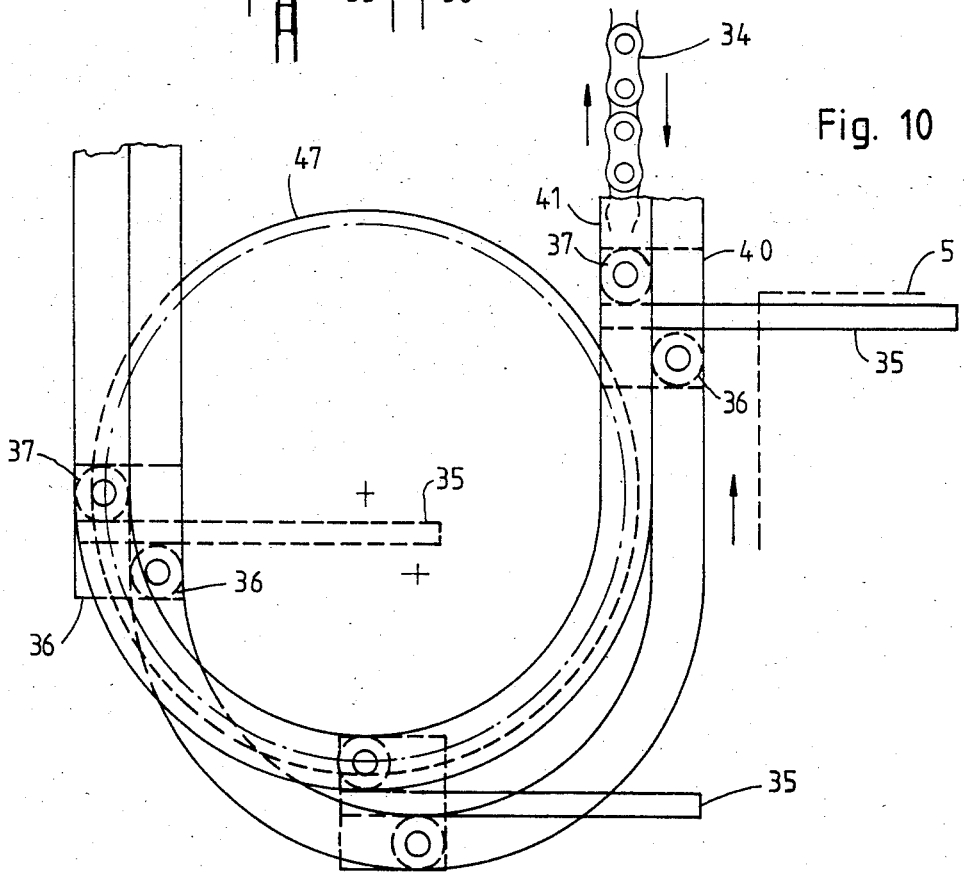

DEVICE ON A FOLDING GRIPPER CYLINDER TO ACCEPT FOLDED PRODUCTS

The invention relates to a device on a folding gripper cylinder to accept and further transport folded products, which have been folded crosswise between the folding gripper cylinder and a folding knife cylinder, by means of a revolving transport device.

Background

From examined German patent application DE-AS No. 21 36 227, it is known to re-open folded paper products by means of a separator, for instance in order to be able to insert accompanying material into the folded product. Typically, a separate device is needed for re-opening folded products, and this increases the cost of the machinery and makes further processing more complicated.

The Invention

It is an object to provide a device with which, without using such devices for opening folded products or partly finished folded products, further handling of the folded products can be done, such as collecting partly finished products together, inserting accompanying material or paying out the folded products.

The invention is an improvement over a conventional folding device, as is known for instance from German Pat. No. 31 42 242, which includes a folding gripper cylinder and, positioned against it, a folding blade cylinder, which may at the same time act as a collection cylinder as well. As is well known, the fold is made here by driving the sheets or packs of sheets resting on the folding blade cylinder into the opened folding gripper in the folding gripper cylinder, using a folding blade located controllably on the folding blade cylinder. The folded products are then removed from the folding device via a revolving transport device, such as a bucket wheel.

Briefly, in accordance with the invention, the revolving transport device, which is provided with drivers, is located in the approximately wedge-shaped area above the point where the folded product is transferred from the folding blade cylinder to the folding gripper cylinder; that the drivers are positioned on the transport device in such a way that one driver at a time, after the folded product has been driven into the folding gripper of the folding gripper cylinder, engages the wedge-shaped area laterally between the two halves, which are still resting on the folding blade cylinder; and once the folded products have been released by the folding grippers, the drivers lift the folded products from the folding gripper cylinder and transport them further.

The device according to the invention offers the advantage that before the two havles of the folded product have been put together and after the fold, or folded spine, has been formed, the drivers, for instance in the form of blades or rods, are introduced laterally into the folding grippers, and with their aid the folded products can be removed from the folding grippers or from the folding blade cylinder and transported further; optionally, after suitable spreading of the two halves of the folded products, it is then easy to add accompanying material, or to assemble folded products. It is also possible, by withdrawing the drivers, to set down the folded products in an imbricated pattern or in packets.

Apparent from the dependent claims and the description, taken together with the drawings. In schematic fashion, the Drawings:

FIG. 1, a side view of the transport device according to the invention on the folding gripper cylinder of a folding apparatus;

FIG. 2, an enlarged illustration of the course over time of the acceptance of the folded products by the transport device;

FIG. 3, a transport device extended partway around the folding gripper cylinder;

FIG. 4, a portion of the transport device in the region where the folded item is accepted;

FIG. 5, obliquely positioned transport devices disposed on both sides of the folded products;

FIG. 6, transport devices extending parallel and disposed on both sides of the folded products;

FIG. 7, a transport device positioned at an obtuse angle;

FIG. 8, a transport device having fixed drivers;

FIG. 9, the diversion of the drivers of FIG. 8 at the transfer point;

FIG. 10, a particular parallel guidance of the drivers at the transfer point;

FIG. 11, a sectional illustration of how the drivers are retained; and

FIG. 12, bracket-like drivers that can be folded in.

Detailed Description

Figure 1:
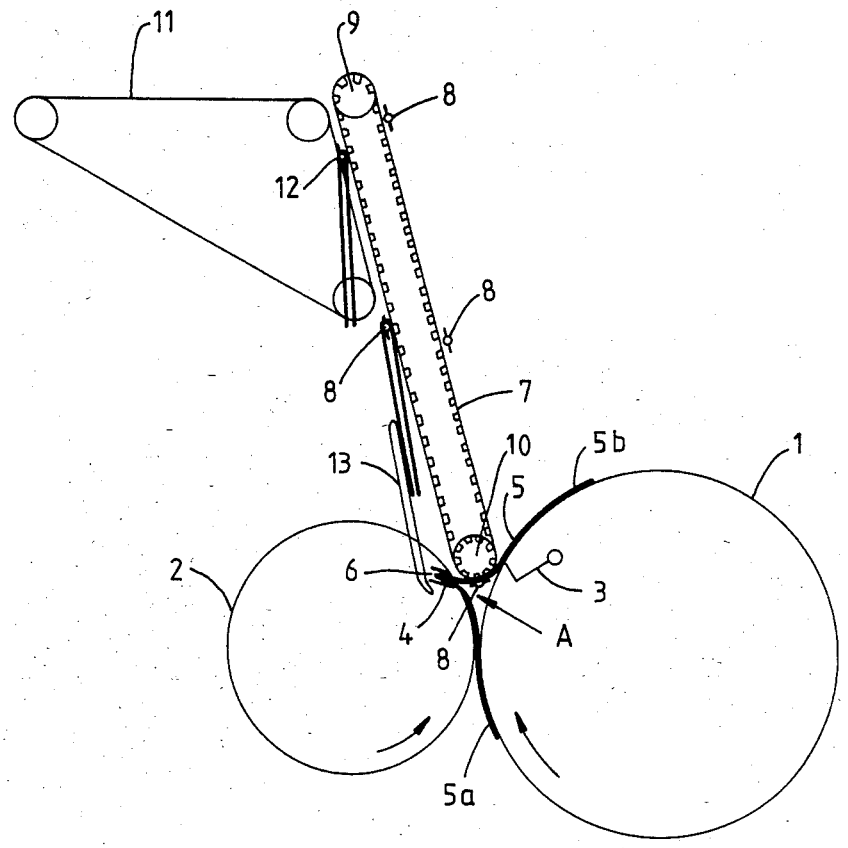

In FIG. 1, a folding blade cylinder 1 and a folding gripper cylinder 2, as typically used in conventional folding apparatus, are indicated. The folding blade cylinder 1 can be used at the same time as a collection cylinder. Controllable folding blades 3 are provided on the folding blade cylinder 1, and controllable folding grippers 4 are provided on the folding gripper cylinder 2; with their aid, one or more sheets 5 stacked one above the other can be provided with a crosswide fold. In a known manner, in order to produce this crosswise fold on a folding line 6, the folding blade is driven at the proper time into the associated folding gripper 4, which is closed either after or during the retraction of the folding blade 3, so as to form the fold and to hold the folded product 5 firmly.

The lower end of a revolving endless transport device, for instance an endless toothed belt 7—a chain may also be used—is positioned in the triangular space A approximately above the transfer point of the folded products 5 on the folding gripper cylinder 2. At specific points, preferably at equal intervals, drivers 8 are secured to the endless toothed belt 7. Preferably, one endless toothed belt 7 each is disposed on either side of the folded products 5, for instance in the plane of the end faces of the cylinders, 2, 3 or parallel thereto. The endless toothed belt 7 is positioned about an upper deflecting wheel 9 and a lower wheel in the above-mentioned wedge-shaped or triangular region A. A further revolving transport device, such as a further endless toothed belt 11, on which drivers 12 are also disposed, extends parallel to the upper region of the endless toothed belt 7.

Figure 2:
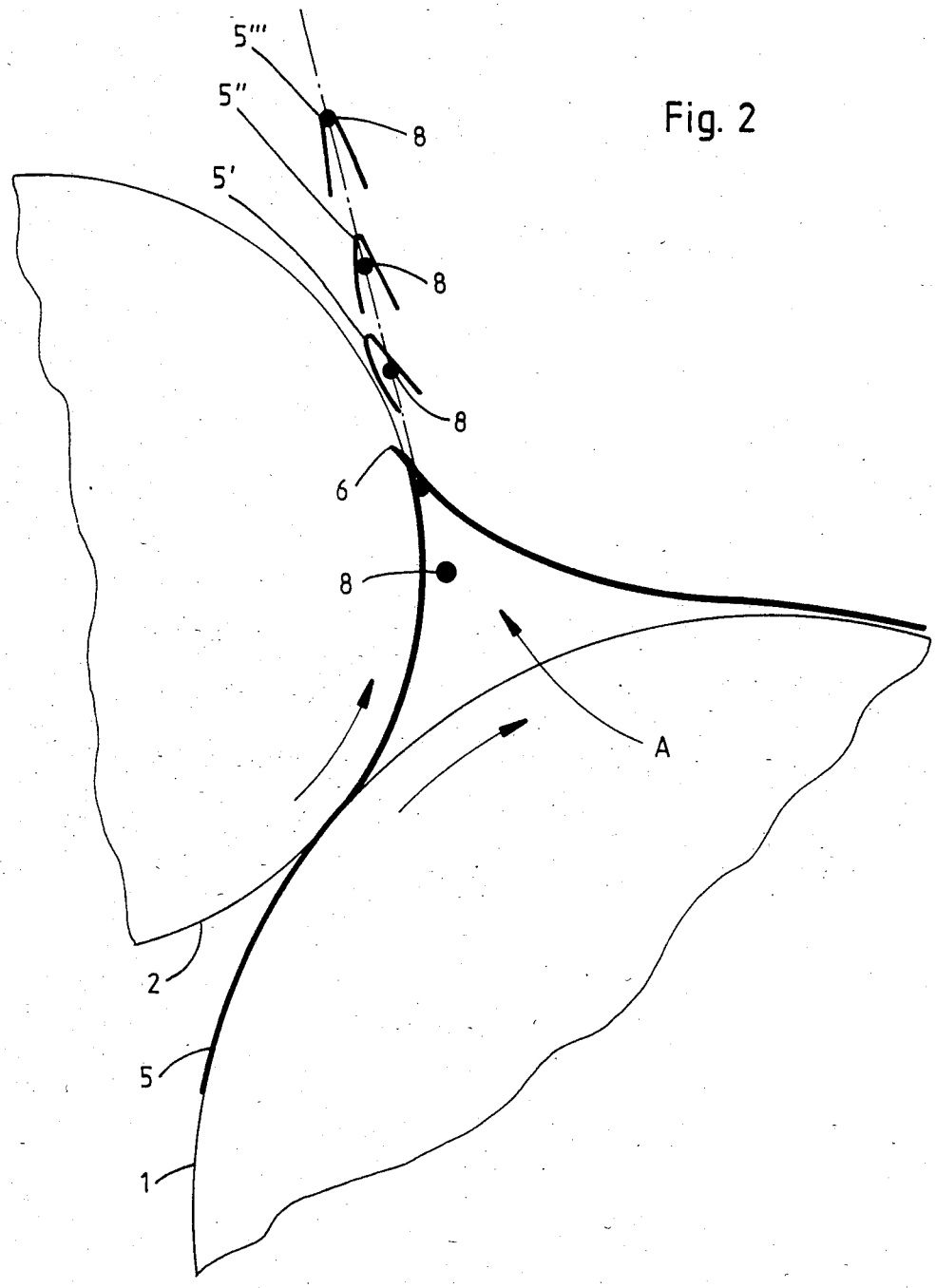

As seen in FIG. 1 taken together with FIG. 2, the sheet or sheets or folded products 5 resting on the folding blade cylinder are driven by one folding knife 3 at a time into the associated folding gripper 4, while the cylinders 1, 2 rotate in opposite directions. As a result, shortly after this insertion, a wedge or triangular space A is created, defined by the two halves 5*a* and 5*b* of the folded products 5. At this time, the folded products 5 are still held in the folding grippers 4 at the folding line 6. In accordance with the invention, at this instant the drivers 8 secured to the endless toothed belt 7 are inserted engagingly between the two halves 5*a* and 5*b* of the folded products 5, preferably from both sides at once. The speed of the endless toothed belt 7 can at most be equal to the circumferential speed of the cylinders 1, 2, but in practice is somewhat less, preferably by approximately 20%. After the insertion of the drivers 8 into the triangular space A, a so-called "gusset", the transfer process of the folded product 5 takes place, which is particularly clearly shown in FIG. 2. Preferably, after the drivers 8 have been introduced into the region A, the folding grippers 4 open, thereby releasing the folded products 5. At the same time, with the aid of a peeler 13 that is additionally provided, the folded products 5 are lifted out of the folding gripper 4. Centrifugal force further reinforces this removal operation. The folded products 5 now "fly", with the folding line 6 in the lead, approximately in a tangential direction with respect to the folding gripper cylinder 2. The speed of the folded products 5 lessens now, so that after a certain period of time the drivers 8 advance as far as the folding line 6. This course is indicated for the folded items 5', 5'', 5''' in FIG. 3. The driver 8 in the position of item 5''' comes to rest on the inside of the fold 6, so that from this instant on the driver 8 assumes the function of guiding and further transporting the folded item 5'''. From now on, the folded items 5''' hang from the two drivers that have been introduced into them from either side. Since identical drivers 12 are disposed on the accepting endless toothed belt 11, the folded items 5 can be accepted by the drivers 12 during their upward movement. Naturally the drivers 8 of the endless toothed belt 7 can, from this moment on, be retracted from the folded items 5 once again.

Figure 3:
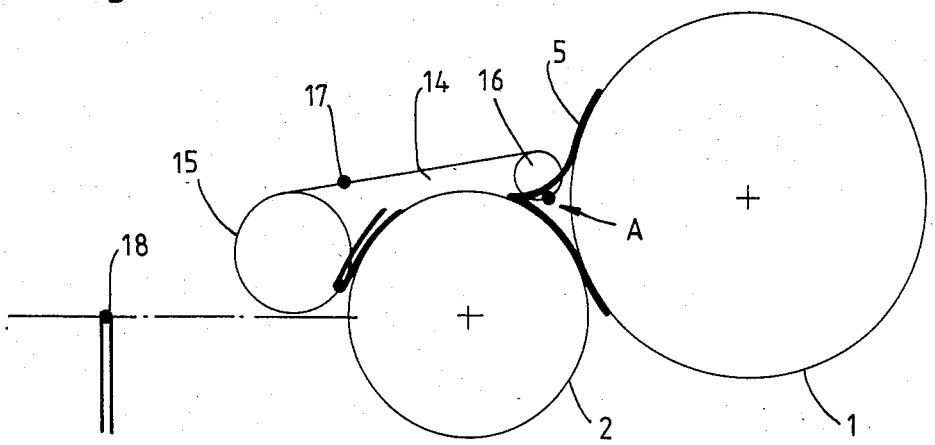

FIG. 3 shows a variant of the embodiment of FIGS. 1 and 2, in which the endless toothed belt 14, which accepts the folded items 5 from the folding gripper cylinder 2 and is guided about deflecting wheels 15, 16, is partially guided about the folding gripper cylinder 2. The process of inserting the drivers 17 on the toothed belt 14 in the wedge-shaped region A is identical to that described above in connection with FIGS. 1 and 2. The only difference is that the folded items 5 are also guided partway around the folding gripper cylinder 2, by or with the drivers 17. The transfer of the folded products then takes place at the driver 18 of a further transport system, not shown in detail.

Figure 4:
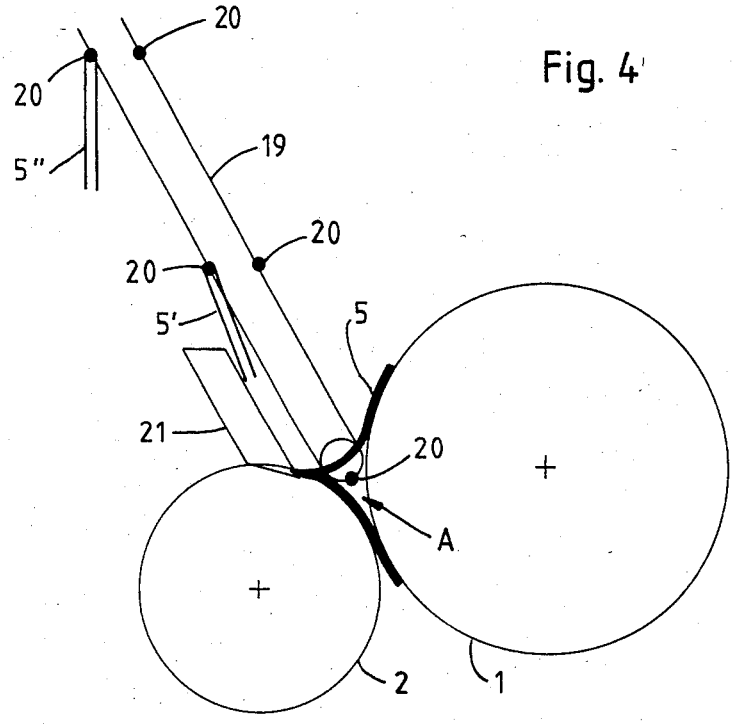

FIG. 4 shows that an endless toothed belt 19 having drivers 20, in place of which a chain could also be used, is disposed preferably in the angle bisector, and the lower deflecting roller, not identified by a reference numeral, of the endless toothed belt 19 should be positioned as far as possible into the region A, that is, in the direction of the transfer point of the folded products from the folding blade cylinder 1 to the folding gripper cylinder 2. Here again, during the process of transferring the folded products 5 to the drivers 20, care is taken, by providing a peeler 21, to assure reliable removal of the folded items 5 from the folding grippers of the folding gripper cylinder 2.

Figure 5:
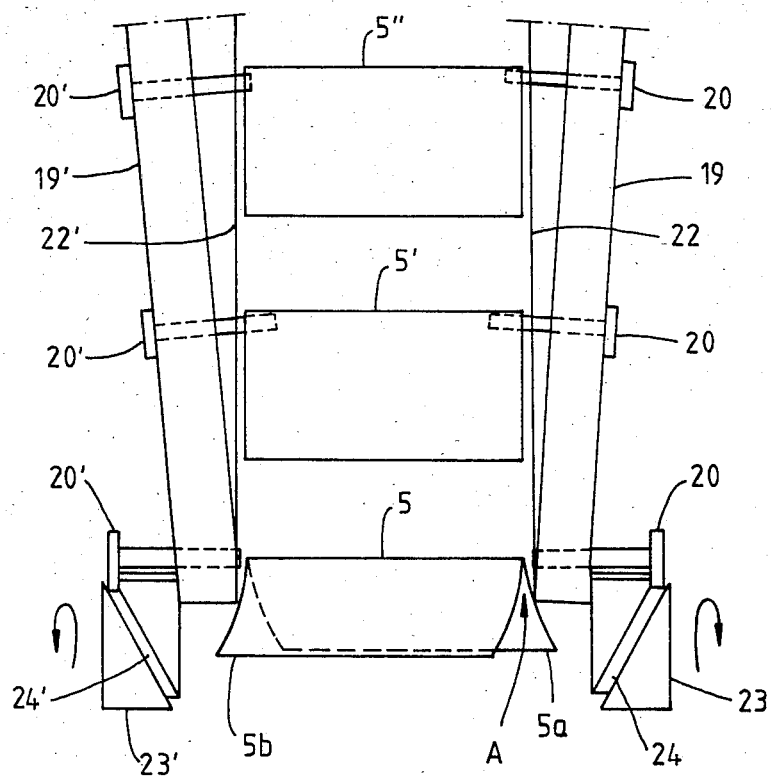

As already noted, revolving transport devices should preferably be used on both sides of the folded items 5. According to FIG. 5, obliquely positioned transport devices in the form of endless toothed belts 19, 19'are used on both sides. Both devices are identical, and so the elements on the left-hand side of the drawing are distinguished from those on the right merely by the addition of a prime. Drivers 20 are disposed on the endless toothed belt 19 and are inserted laterally between the two halves 5*a*, 5*b* of the folded item 5 in the area A by means of a mechanical control device. These devices may for instance comprise cam discs 23, which are equipped with an appropriate control zone 24, such as a groove. As a result, the drivers 20 that are guided in the control zone 24 can be driven inward at the instant at which the folded items 5 are held in the folding grippers 4 (FIG. 1), that is, whenever the wedge-shaped area A is formed by the halves 5*a*, 5*b*. As FIG. 5 shows, the oblique positioning of the toothed belts 19, 19' automatically assures that the drivers 20 or 20' are removed from the folded items 5 or 5', 5''. In order to guide the folded items 5, 5', etc., in a desired direction, guide plates or similar guide devices 22, 22' can be provided.

Figure 6:
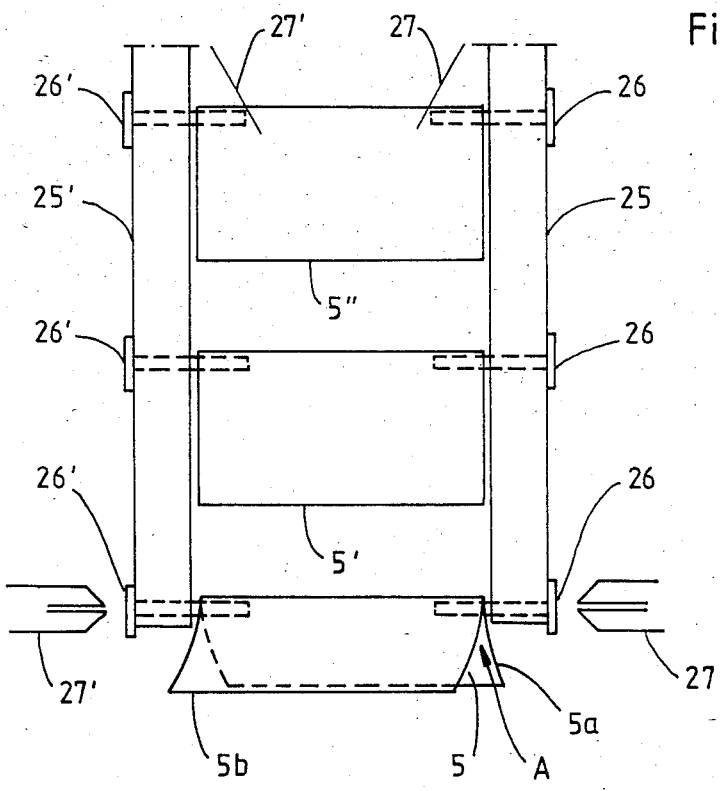

In the embodiment of the invention shown in FIG. 6, the revolving transport devices disposed on either side of the folded items 5, 5', 5'', 5''' are in the form of chains or belts 25 and are positioned in parallel. Therefore the drivers 26 in the region A must be inserted at the proper time by means of additional control devices 27. This can be achieved for instance by pushing the drivers 26 inward using control devices 27 in the form of pneumatic, hydraulic or magnetic elements. By means of devices acting in the reverse direction, not shown, the drivers 26 can then each be pulled outward once again, after the folded products have been transferred to some other system.

Figure 7:
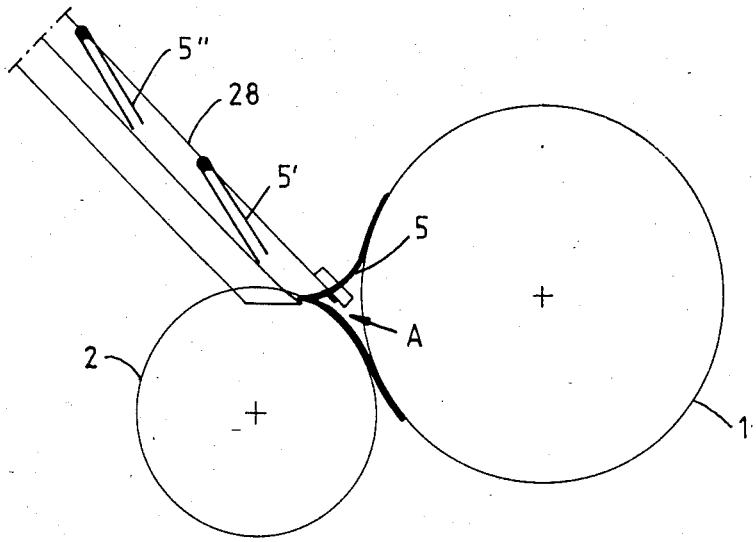

FIG. 7 shows an arrangement in which the acceptance of the folded products 5 and their further transporting are effected by a relatively obliquely positioned transport system, in the form of a revolving toothed belt 28, on the upper run of this belt.

Figure 8:
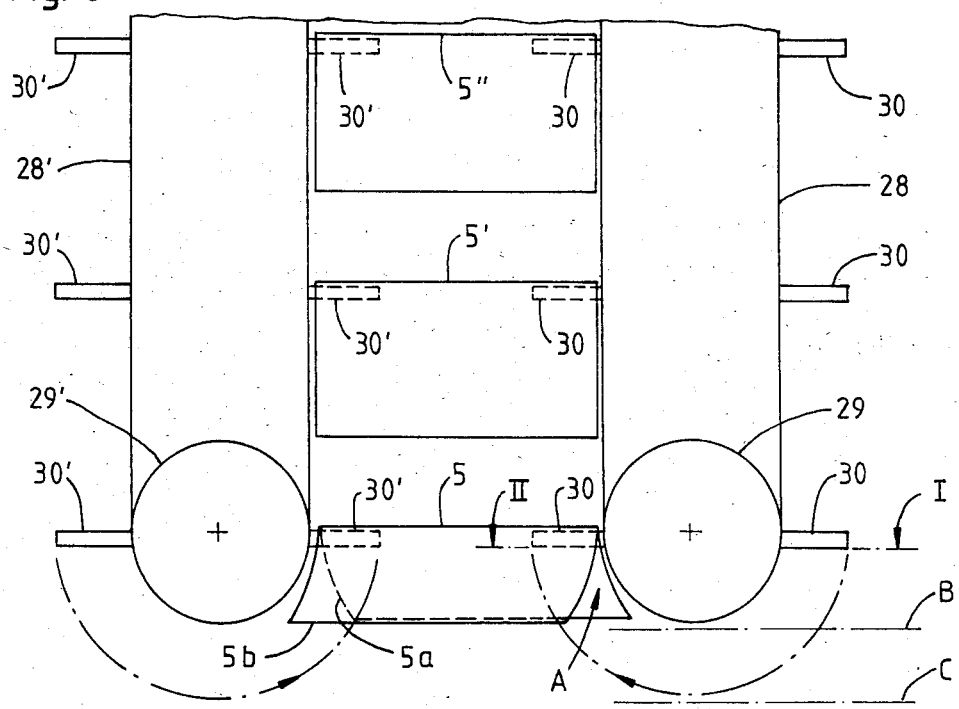
Figure 9:
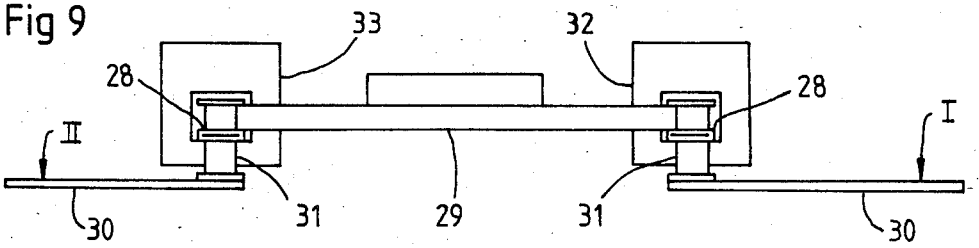

A further advantageous device is shown in FIGS. 8 and 9. Here again, revolving transport devices in the form of chains or belts 28, on each of which drivers 30 are secured, are disposed on either side of the folded products 5, 5', 5'', 5''' that are to be transferred. Only the lower portion of the toothed belt 28, 28' is shown, in which the transfer of the folded products 5 into the region A takes place. The position of the folding gripper cylinder 2 is shown at "C" in FIG. 8. At the transfer region A, the toothed belts 28, 28' are guided about deflecting wheels 29, 29', and the drivers 30, 30' receive the folded product 5 that is to be accepted as they travel about the deflecting wheels 29, 29'. The pivoting arc of the drivers 30, 30' defines the distance between the deflecting wheel 29 and the folding gripper cylinder 2, which is indicated by the line C. As shown in FIG. 8, as the toothed belt 28 revolves about the wheel 29, one driver 30 at a time is advanced inward into the still-separated halves 5*a*, 56 of the folded product 5, which at this instant, as has already been explained in conjunction with FIG. 1, is still being held in the folding grippers. After the ensuing release of the folded products 5 from the folding grippers, the folded items 5, 5', 5'', 5''' are transported further by the drivers 30, 30' of the endless toothed belts 28, 28' disposed on either side.

FIG. 9 is a sectional view taken along the line I–II [sic] and shows that the drivers 30 can be fixed in the revolving transport device 28, which is in the form of a linked chain, for instance, via securing bolts 31. The chain 28 can be disposed in respective guides 32 and 33 for the inner and outer track. The result is an exact guidance of the folded items 5.

As shown in FIG. 8, the pivoting movement of the drivers 30 about the wheel 29 requires a relatively large amount of space, which under some circumstances may not allow the necessary closeness of the deflecting wheel 29 to the folding gripper cylinder. In order to decrease this distance, for instance from C to the line B in FIG. 8, an advantageous guide for the endless belt, or for the chain 34 of FIGS. 10 and 11, can be used. In this guide, the pivoting movement shown in FIG. 8 for the drivers 30 and the deflecting wheel 29 is avoided. What takes place is virtually a linear displacement of the drivers 35 from the inside outward, during a passage around the devlecting wheel 47. The drivers 35 are secured on the chain 34 via a slide 36, which travels in ball bearings 37 in two guide rails 40, 41. The ball bearings 37 rest on bolts 38, 39, of which the bolt 39 can advantageously serve at the same time as the extension of a casing of the guide chain 34.

FIG. 10 shows that when the chain 34 is transported in the direction of the arrow, the drivers 35 always remain horizontal, whenever they are driven counterclockwise about the deflecting wheel 47, so that on the right-hand side, in the region A, they can be introduced into the still-separated halves 5*a*, 5*b* of a folded product 5, and can assume the function of further transport once the folded product 5 has been transferred from the folding gripper cylinder 2 or the folding blade cylinder 1.

Finally, FIG. 12 shows a further variant. Here two inwardly pivotable arms 43, 44 are secured on a bracket 42, the width of which, as indicated by double-headed arrows, can be adapted to the widths of the folded products 5, for instance by means of a telescoping arrangement. In the region A, the drivers 43, 44 can be introduced into the separated halves 5*a*, 5*b* of the folded products 5 by laterally disposed control means, for instance in the form of guide plates 45, 46. The transporting of the brackets 5 [sic] with the drivers 43, 44 can again be effected by a centrally disposed endless belt 44 or a corresponding chain.

Further handling, such as inserting accompanying material or collecting folded products 5, can advantageously be done using devices described in the application U.S. Ser. No. 756,799 of the same date Hechler, assigned to the assignee of this application.

It will be understood that the invention can also be used in a folding device in which the folded product (sheets or packets of sheets) is pushed through between two rollers by means of a blade. Here again, a wedge-shaped area or is created, into which the drivers can be laterally introduced. Depressions extending only in the circumferential direction should be provided if needed in the rollers, to enable the passage therethrough of the drivers.

I claim:

1. Device on a folding gripper cylinder to accept and further transport the folded products provided between a folding gripper cylinder and a folding blade cylinder with a crosswise fold, by means of a revolving transport device, characterized in that the revolving transport device (7), provided with drivers (8), is arranged in the approximately wedge-shaped region (A) behind the transfer point of the folded product (5) from the folding blade cylinder (1) to the folding gripper cylinder (2), that the drivers (8) are positioned on the transport device (7) in such a manner that one driver at a time, after the insertion of the folded product (5) into the folding gripper (4) of the folding gripper cylinder (2) is inserted engagingly into the region (A) between the two halves (5*a*, 5*b*), which are still resting on the folding blade cylinder (1), and that after the release of the folded product (5) by the folding grippers (4), the drivers (8) transport the folded products (5) further after they have been removed from the folding gripper cylinder (2).

2. Device according to claim 1, characterized in that on either side of the folded products (5) that are to be accepted, one transport device (7) is provided, each of which includes an endless toothed belt or an endless chain, the deflecting wheel (10) of which is disposed in or above the wedge shaped region (A).

3. Device according to claim 1, characterized in that a folding product peeler device (13) is provided on the folding gripper cylinder (2), engaging below the jacket contour thereof.

4. Device according to claim 1 characterized in that the speed of revolution of the drivers (8) is lower than the circumferential speed of the folding blade cylinder (1) and the folding gripper cylinder (2).

5. Device according to claim 4, charcterized in that the speed of revolution of the drivers (8) is approximately 10 to 20% lower than the circumferential speed of the folding blade cylinder (1) and the folding gripper cylinder (2).

6. Device according to claim 1 characterized in that the revolving transport device (14) having the drivers (17) wraps partway around the folding gripper cylinder (2) (FIG. 3).

7. Device according to claim 1, characterized in that with an increasing movement component, the drivers (8) accept the folded products (5) from the folding gripper cylinder (2) and transport them further.

8. Device according to claim 1 characterized in that the revolving transport devices (25, 25′, 28, 28′) disposed on either side of the folded products (5) extend parallel to one another.

9. Device according to claim 1 characterized in that the revolving transport device (19, 19′) disposed on either side of the folded products (5) extend obliquely to one another, in such a manner that the distance between them is least on either side of the region A and that on either side of the wedge shaped region (A) the drivers (20, 20′ are inserted from the side between the halves (5*a*, 5*b*) by a control device (23, 23′), and that after a predetermined region, the drivers (20, 20′) are retracted from the folded product (5, 5′, 5″) by the obliquely positioned revolving transport devices (19, 19′) (FIG. 5).

10. Device according to claim 1, characterized in that in the wedge shaped region (A) the drivers (26, 26′) are inserted from the side in between the halves (5*a*, 5*b*) of the folded product (5) by means of a control device (27, 27′) for a predetermined travel distance (FIG. 6).

11. Device according to claim 1, characterized in that the drivers (30) in the wedge shaped region (A) are guided about a deflecting wheel (29) in such a manner that in the region A they are pivoted from below in between the halves (5*a*, 5*b*) of the folded products (5) (FIG. 8).

12. Device according to claim 1 characterized in that the drivers (35) are guided on a slide (36), which is guided in a left (41) and right (40) guide by a chain (34) about a deflecting wheel (47) in such a manner that the drivers (35), as the chain (34) is guided about the deflecting wheel (47), are inserted in approximately the same angular position (for instance, horizontal) laterally in the rising area of the guides (40, 41) for transfer of the folded products (5) in the area between the halves (5*a*, 5*b*) of the folded items (FIG. 10).

13. Device according to claim 12, characterized in that the slide (36) is guided in ball bearings (37) between the guides (40, 41) and that the ball bearings (37) are positioned on elongated connecting bolts of the sprocket chain (34).

14. Device according to claim 1, characterized in that the drivers (43, 44) are pivoted on either side of the folded product, in the wedge shaped region (A), by control elements (45, 46) and are positioned on a centrally arranged revolving transport device (44) on a common bracket (42).

15. Device according to claim 1 characterized in that instead of folding gripper and folding blade cylinders, a pair of folding rollers provided with depressions is used, between which the folded products are pushed through.

* * * * *